United States Patent [19]

Gilgenbach et al.

[11] Patent Number: 4,802,822

[45] Date of Patent: Feb. 7, 1989

[54] MARINE PROPELLER WITH OPTIMIZED PERFORMANCE BLADE CONTOUR

[75] Inventors: Hubert S. Gilgenbach, Butte des Morts; Ronald M. Steiner, Oshkosh, both of Wis.

[73] Assignee: Brunswick Corporation, Skokie, Ill.

[21] Appl. No.: 106,140

[22] Filed: Oct. 8, 1987

[51] Int. Cl.[4] ..... B63H 1/26

[52] U.S. Cl. ..... 416/235; 416/243

[58] Field of Search ..... 416/223 R, 235, 242, 416/243, 239, DIG. 2

[56] References Cited

U.S. PATENT DOCUMENTS

| | | | |
|---|---|---|---|
| 1,019,437 | 3/1912 | Draper | 416/243 |
| 1,455,591 | 5/1923 | Lawson | 416/235 X |
| 1,639,785 | 8/1927 | Sepulveda | 416/243 |
| 2,047,847 | 7/1936 | Ambjornson | 416/243 |
| 3,312,286 | 4/1967 | Irgens | 416/243 |
| 3,697,193 | 10/1972 | Phillips | 416/243 X |
| 4,073,601 | 2/1978 | Kress | 416/242 |
| 4,080,099 | 3/1978 | Snyder | 416/146 R |
| 4,331,429 | 5/1982 | Koepsel et al. | 440/49 |
| 4,632,636 | 12/1986 | Smith | 416/223 R |

FOREIGN PATENT DOCUMENTS

| | | | |
|---|---|---|---|
| 435993 | 10/1935 | United Kingdom | 416/235 |

OTHER PUBLICATIONS

"Everything you Need to Know About Propellers", Third Edition, Mercury Marine, Brunswick Corporation, QS5-384-10M, Part No. 90-86144, 1984.

*Primary Examiner*—Robert E. Garrett
*Assistant Examiner*—Joseph M. Pitko
*Attorney, Agent, or Firm*—Robert C. Curfiss

[57] ABSTRACT

A marine propeller (4) combines decreasing overall pitch from hub (6) to blade tip (20) and increasing progressiveness of pitch with increasing radii from hub to tip, and provides uniform loading from hub to tip. The balde has a maximum transverse dimension (36, 46, 48) between the high pressure surface (16) of the blade and a straight line chord (34, 34*a*, 34*b*) between the leading edge (22) and the trailing edge (24) of the blade. The ratio of this maximum transverse dimension to the length of the chord is ever increasing from hub to tip. A parabolic blade rake along the maximum radial dimension line (50) of the blade is provided in combination.

5 Claims, 1 Drawing Sheet

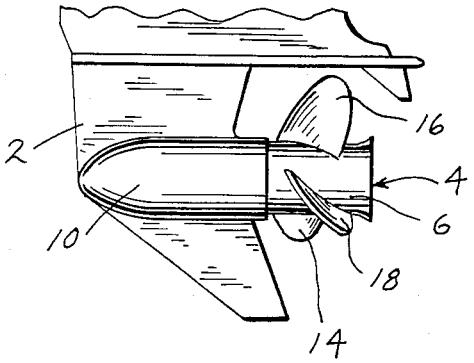
FIG. 1
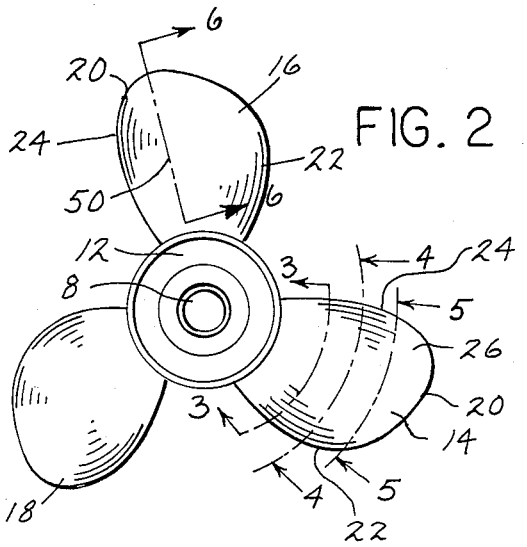
FIG. 2
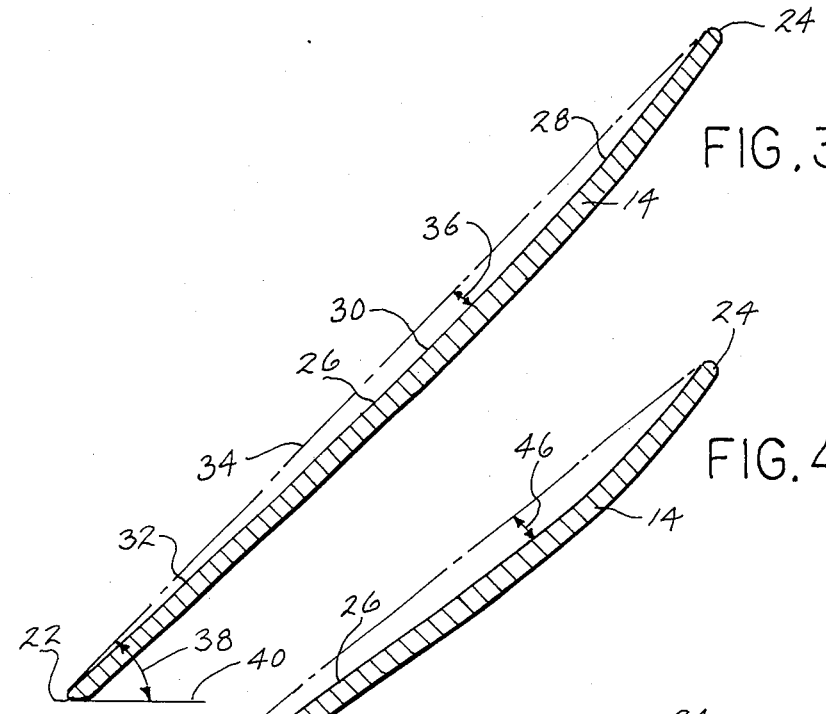
FIG. 3
FIG. 4
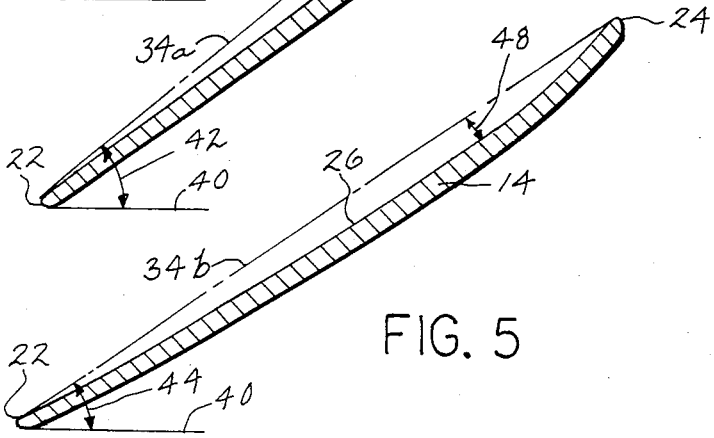
FIG. 5
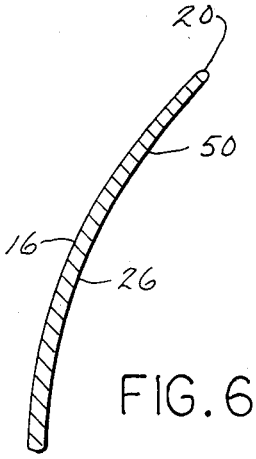
FIG. 6

MARINE PROPELLER WITH OPTIMIZED PERFORMANCE BLADE CONTOUR

BACKGROUND AND SUMMARY

The invention arose during development efforts directed toward optimized performance marine propellers.

The invention provides uniform loading of the pressure surface of a marine propeller blade from hub to tip. In the preferred embodiment, the blade pressure surface is contoured with increasing progressiveness of pitch with increasing radii from hub to tip, in combination with decreasing overall pitch from hub to tip, and a parabolic blade rake. For further background regarding marine propeller blade design, reference is made to "Everything You Need to Know about Propellers", Third Edition, Mercury Marine, Brunswick Corporation, QS5-384-10M, Part No. 90-86144, 1984, and to U.S. Pat. Nos. 3,312,286, 4,073,601, 4,080,099, 4,331,429 and 4,632,636.

BRIEF DESCRIPTION OF THE DRAWINGS

FIG. 1 is a side elevation view of a marine lower drive unit with a propeller.

FIG. 2 is an end view of the propeller of FIG. 1.

FIG. 3 is a sectional view taken along line 3—3 of FIG. 2.

FIG. 4 is a sectional view taken along line 4—4 of FIG. 2.

FIG. 5 is a sectional view taken along line 5—5 of FIG. 2.

FIG. 6 is a sectional view taken along line 6—6 of FIG. 2.

DETAILED DESCRIPTION

FIG. 1 shows a marine lower drive unit 2 having a propeller 4 with a hub 6 mounted on a propeller shaft 8, FIG. 2, extending from torpedo housing 10. Hub 6 includes a through-hub-exhaust passage 12, as known in the art, and which is optional. Propeller hub 6 has a plurality of blades 14, 16 and 18 extending generally radially outwardly therefrom to respective outer tips such as 20. Each blade has a leading edge 22 and a trailing edge 24. Each blade has a high pressure surface such as 26 defined between hub 6 and outer tip 20 and between leading edge 22 and trailing edge 24.

As known in the art, for example pages 6 and 7 of the above noted "Everything You Need to Know about Propellers", Mercury Marine, blade pitch is the distance that a propeller would move in one revolution if it were traveling through a soft solid, like a screw in wood. The higher the pitch, the more axial movement of the propeller or screw per revolution. Progressive pitch is a change of the blade pitch from leading edge to trailing edge along a given radius from the hub, and is known in the art. Progressive pitch starts low at the leading edge and progressively increases to the trailing edge, pages 6 and 7 of the above noted "Everything You Need to Know about Propellers", Mercury Marine. The present invention utilizes a progressive pitch from leading edge to trailing along a given radius from the hub. As shown in FIG. 3, the pitch at area 28 of pressure surface 26 of the blade is higher than the pitch at area 30 which in turn is higher than the pitch at area 32, thus providing a progressive pitch, i.e. pitch increases from leading edge 22 to trailing edge 24. Progressive pitch defines a concave camber from leading edge to trailing edge wherein the more progressive the pitch the more the camber, i.e. the more concavity. A straight line from leading edge 22 to trailing edge 24 defines a chord 34. The maximum transverse dimension 36 from chord 34 to blade pressure surface 26 relative to the chord length defines the degree of camber or concavity.

Overall pitch is defined by the pitch angle 38 between chord 34 and radial reference line 40. Line 40 is perpendicular to the axis of rotation of the propeller.

In the present invention, the blade pressure surface is contoured with decreasing overall pitch from hub to tip in combination with increasing progressiveness of pitch with increasing radii from hub to tip. FIG. 3 shows a cross section of the blade relatively close to hub 6. FIG. 4 shows a cross section in a central portion of the blade. FIG. 5 shows a cross section near the outer portion of the blade. As above noted, reference character 38 shows the angle between chord 34 and radial reference line 40 relative to the hub. Reference character 42 shows the angle between chord **34*a* in FIG. 4 and radial reference line 40. Reference character 44 shows the angle between chord 34*b* in FIG. 5 and radial reference line 40. Angle 44 is less than angle 42 which is less than angle 38. Overall pitch decreases from hub to tip, as illustrated by decreasing angles 38, 42 and 44 in FIGS. 3–5**, respectively.

The decreasing overall pitch from hub to tip is provided in combination with increasing progressiveness of pitch with increasing radii from hub to tip. Dimension 46 in FIG. 4 is the maximum transverse dimension from chord **34*a* to blade pressure surface 26. Dimension 48 in FIG. 5 is the maximum transverse dimension from chord 34*b* to blade pressure surface 26. The ratio of transverse dimension 46 to the length of chord 34*a* is greater than the ratio of transverse dimension 36 to the length of chord 34. The ratio of transverse dimension 48 to the length of chord 34*b* is greater than the ratio of transverse dimension 46 to the length of chord 34*a***. The progressiveness of pitch increases with increasing radii from hub to tip. The increasing progressiveness of pitch with increasing radii from hub to tip defines increasing camber with increasing radii.

It is significant to note that the ratio of the maximum transverse dimension to the chord length increases from hub to tip. The maximum transverse dimension between pressure surface 26 of the blade and respective chords 34, **34*a* and 34*b* is defined by respective dimensions 36, 46 and 48**. Camber is expressed by this dimension divided by the length of the respective chord. This ratio, i.e. camber, is ever increasing from the hub to the tip of the blade.

The increasing progressiveness of pitch from hub to tip in combination with decreasing overall pitch from hub to tip provides uniform loading of the pressure surface of the blade from hub to tip and prevents overloading of the tip. The highest pitch and lowest camber of the blade pressure surface is at the hub. The lowest pitch and highest camber of the blade pressure surface is at the tip.

In the one embodiment, dimension 36 is about 0.8% of the length of chord 34. Dimension 46 is about 2.1% of the length of chord **34*a*. Dimension 48 is about 2.7% of the length of chord 34*b*. Angle 38 is about 44°. Angle 42 is about 37°. Angle 44** is about 32°.

As known in the art, when a propeller blade is examined on a radial cut extending through the hub, the cross section of that cut blade represents blade rake, as discussed in the above noted "Everything You Need to Know about Propellers", Mercury Marine. If the blade high pressure surface is perpendicular to the propeller hub, the propeller has zero degrees rake. As the blade slants back toward the aft end of the propeller, blade rake increases. A parabolic blade rake is known in the art, and is defined by the high pressure surface formed along a parabolic curve. In the present invention, a parabolic blade rake is provided along the maximum radial dimension 50 of the blade, FIGS. 2 and 6. The blade rake is parabolic only along the maximum radial line 50 and not along the forward portion of the blade between line 50 and leading edge 22, and not along the aft portion of the blade between line 50 and trailing edge 24.

It is recognized that various equijalents, alternatives and modifications are possible within the scope of the appended claims.

We claim:

1. A marine propeller comprising a hub having a plurality of blades extending generally radially outwardly therefrom to respective outer tips, each blade having a leading edge and a trailing edge, each blade having a pressure surface defined between said hub and said outer tip and between said leading edge and said trailing edge, said pressure surface having a progressive pitch from said leading edge to said trailing edge along a given radius from said hub, and means providing uniform loading of said pressure surface from said hub to said tip and preventing overloading of said tip, comprising a contoured said pressure surface having increasing progressiveness of said pitch with increasing radii from said hub to said tip.

2. A marine propeller comprising a hub having a plurality of blades extending generally radially outwardly therefrom to respective outer tips, each blade having a leading edge and a trailing edge, each blade having a pressure surface defined between said hub and said outer tip and between said leading edge and said trailing edge, each blade having a contoured pressure surface with decreasing overall pitch from said hub to said tip, in combination with a progressive pitch from said leading edge to said trailing edge along a given radius from said hub, and in combination with increasing progressiveness of said pitch with increasing radii from said hub to said tip, said progressive pitch defining a concave camber from said leading edge to said trailing edge wherein the more progressive the pitch the more the camber, said increasing progressiveness of said pitch with increasing radii from said hub to said tip defining increasing camber with increasing radii from said hub to said tip, such that the highest pitch and lowest camber of said blade pressure surface is at said hub and such that the lowest pitch and highest camber of said blade pressure surface is at said tip.

3. The invention according to claim 2 wherein said leading edge of said blade and said trailing edge of said blade define a straight line chord therebetween, and wherein said concave camber defines a given maximum transverse dimension from said chord to said pressure surface of said blade, and wherein said blade has a central portion between said hub and said outer tip defining a given intermediate ratio of said maximum transverse dimension to the length of said chord, and wherein said blade has an inner portion between said central portion and said hub defining a given inner ratio of said maximum transverse dimension to the length of said chord, and wherein said blade has an outer portion between said central portion and said outer tip defining a given outer ratio of said maximum transverse dimension to the length of said chord, and wherein said outer ratio is greater than said intermediate ratio and wherein said intermediate ratio is greater than said inner ratio.

4. The invention according to claim 3 wherein each of said blades has a maximum radial dimension line from said hub to said tip, and wherein said blade pressure surface has a parabolic rake along said maximum radial dimension line.

5. The invention according to claim 4 wherein said rake is parabolic only along said maximum radial dimension line and not along the forward portion of said blade between said maximum radial dimension line and said leading edge, and not along the aft portion of said blade between said maximum radial dimension line and said trailing edge.

* * * * *